US007620353B2

(12) United States Patent
Kwak

(10) Patent No.: US 7,620,353 B2
(45) Date of Patent: Nov. 17, 2009

(54) IMAGE FORMING APPARATUS AND CONTROL METHOD FOR DRIVING THE SAME

(75) Inventor: Jin-geun Kwak, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 430 days.

(21) Appl. No.: 11/491,076

(22) Filed: Jul. 24, 2006

(65) Prior Publication Data

US 2007/0166080 A1 Jul. 19, 2007

(30) Foreign Application Priority Data

Jan. 17, 2006 (KR) ..... 10-2006-0004981

(51) Int. Cl.
*G03G 15/01* (2006.01)

(52) U.S. Cl. ..... 399/302; 399/299

(58) Field of Classification Search ..... 399/126, 399/302, 308, 299
See application file for complete search history.

(56) References Cited

U.S. PATENT DOCUMENTS

| | | | | |
|---|---|---|---|---|
| 6,064,848 | A * | 5/2000 | Haneda | 399/302 |
| 6,470,166 | B2 * | 10/2002 | Mizoguchi et al. | 399/302 |
| 6,920,291 | B2 * | 7/2005 | Saitoh et al. | 399/302 |
| 7,062,209 | B2 * | 6/2006 | Murakami et al. | 399/299 |
| 7,164,877 | B2 * | 1/2007 | Murakami et al. | 399/299 |
| 7,317,890 | B2 * | 1/2008 | Kyung | 399/299 |
| 2002/0181976 | A1 * | 12/2002 | Takahata et al. | 399/302 |
| 2005/0002695 | A1 * | 1/2005 | Yamada | 399/302 |
| 2006/0099013 | A1 * | 5/2006 | Ahn et al. | 399/302 |
| 2007/0116496 | A1 * | 5/2007 | Morimoto et al. | 399/299 |

FOREIGN PATENT DOCUMENTS

| | | |
|---|---|---|
| JP | 3-251884 | 11/1991 |
| JP | 2001-158555 | 6/2001 |
| JP | 2005-316320 | 11/2005 |
| KR | 1999-18464 | 3/1999 |
| WO | WO 2005/036276 | 4/2005 |
| WO | WO 2005036276 A1 * | 4/2005 |

OTHER PUBLICATIONS

Korean Patent Abstract of Publication No. 100219660 B1.
Office Action issued in Chinese Patent Application No. 2007100022960 on Aug. 29, 2008.

* cited by examiner

*Primary Examiner*—Susan S Lee
(74) *Attorney, Agent, or Firm*—Stein McEwen, LLP

(57) ABSTRACT

An image forming apparatus and control method, the image forming apparatus including: a first image bearing body and a second image bearing body aligned to form predetermined color images; a transfer belt supported by a driving roller and a driven roller, to transfer images onto a printing medium; a first primary transfer roller installed on the opposite side of the first image bearing body, having the transfer belt in-between; a second primary transfer roller movably installed on the opposite side of the second image bearing body, having the transfer belt in-between, to engage/disengage the transfer belt with/from the second image bearing body by selectively changing the traveling track of the transfer belt; a driving unit to drive the second primary transfer roller to engage/disengage with/from the transfer belt; and a belt length adjusting unit to control the traveling distance of the transfer belt to be constant.

46 Claims, 2 Drawing Sheets

IMAGE FORMING APPARATUS AND CONTROL METHOD FOR DRIVING THE SAME

CROSS-REFERENCE TO RELATED APPLICATIONS

This application claims under 35 U.S.C. § 119(a) priority to and benefit of Korean Patent Application No. 2006-4981, filed Jan. 17, 2006 in the Korean Intellectual Property Office, the entire contents of which are incorporated herein by reference.

BACKGROUND OF THE INVENTION

1. Field of the Invention

Aspects of the invention relate to an image forming apparatus, and, more specifically, to an image forming apparatus in which images are transferred and superposed onto a transfer medium by a plurality of image bearing bodies.

2. Description of the Related Art

In general, color image forming apparatuses are classified into two types: a multi-pass system which forms a color image by rotating an image bearing body (e.g., photosensitive drum) multiple times, and a single-pass (tandem type) system which forms a color image by rotating each of a plurality of image bearing bodies one time.

The multi-pass system image forming apparatus forms a color image by rotating one image bearing body multiple times, so the printing speed is relatively slower than in the single-pass system image forming apparatus. However, since the multi-pass system typically uses only a single image bearing body, a relatively small number of components are used, resulting in a simple constitution. In this sense, the multi-pass system is advantageous in that it contributes to a compact-size image forming apparatus. For instance, in the multi-pass system image forming apparatus, a plurality of color images, i.e., yellow, magenta, cyan, and black color images, which are formed through a predetermined operation, are transferred onto a transfer medium, such as a transfer belt and superposed (primary transfer) with each other. Then, the full color images superposed on the transfer medium are transferred onto a recording medium (secondary transfer). Therefore, since one image bearing body typically is rotated four turns to develop a single full-color image, the printing speed can be slow.

On the other hand, the single-pass system image forming apparatus includes four image bearing bodies corresponding to yellow, magenta, cyan and black color images. During one rotation of a transfer medium, the four color images formed on their corresponding image bearing bodies are transferred in sequence onto the transfer medium and superposed with each other to make a full color image. Thus, the printing speed is typically shortened. However, since the single-pass system generally requires an image bearing body for each color, it can be difficult to manufacture a small-sized and light-weight image forming apparatus of a low-price for consumers.

Also, an image forming apparatus having a combined system of the single-pass and the multi-pass system has been developed. According to this system, the number of image bearing bodies is less than in the single-pass system, whereas its printing speed is faster than in the multi-pass system. This image forming apparatus includes only two image bearing bodies, in which one (first) of the image bearing bodies is used to form yellow, magenta, and cyan color images based on the multi-pass system and the other (second) image bearing body is used to form a black color image. The yellow and magenta color images are superposed on a transfer medium through the first image bearing body, and then a cyan color image is finally superposed thereon. This image transfer onto a transfer medium is carried out using the single-pass system so that a full-color image can be formed on the transfer medium. In other words, to form a full-color image on the transfer medium, the first image bearing body makes first two rotations and then the first and second image bearing bodies together make a third rotation. Thus, as previously mentioned, the image forming apparatus having the combined system typically has less components and less manufacturing cost than the image forming apparatus with four image bearing bodies, and can realize a faster printing speed than in the image forming apparatus with one image bearing body.

However, in the above described image forming apparatus system, the second image bearing body is typically disengaged from the transfer medium farther than the application range until the magenta color image is formed through the first image bearing body, and is within the application range of the transfer medium when the cyan color image is formed. One way to accomplish this is to adjust the space between the first image bearing body and the transfer medium by adjusting the traveling trajectory of the transfer medium. However, such adjustment can cause the transfer medium to slip from the track and, therefore, the images on the first and second image bearing bodies can be tilted over and banding is more likely to be noticed.

SUMMARY OF THE INVENTION

Several aspects and example embodiments of the invention provide an image forming apparatus with an improved structure to prevent the tilt of a transfer medium during the adjustment of a traveling track of the transfer medium.

To achieve the above and/or other aspects and advantages of the invention, there is provided an image forming apparatus, including: a first image bearing body and a second image bearing body aligned to form predetermined color images; a transfer belt supported by a driving roller and a driven roller, and traveling in one direction, or a predetermined direction, to transfer images onto a printing medium, wherein the images are formed on the first and the second image bearing bodies and transferred and superposed onto the transfer belt; a first primary transfer roller installed on the opposite side of the first image bearing body, having the transfer belt positioned in-between; a second primary transfer roller movably installed on the opposite side of the second image bearing body, having the transfer belt positioned in-between, to engage or disengage the transfer belt with or from the second image bearing body by selectively changing the traveling track of the transfer belt; a driving unit to drive the second primary transfer roller to selectively engage and disengage with and from the transfer belt; and a belt length adjusting unit to control the traveling distance of the transfer belt traveling via the first image bearing body, with the second image bearing body and the driving roller being constant by changing the traveling track of the transfer belt around the second image bearing body to compensate a change in the traveling track of the transfer belt caused by the second primary transfer roller.

According to aspects of the invention, the belt length adjusting unit includes: a track adjusting roller disposed between the second primary transfer roller and the driving roller to support the transfer belt, with the track adjusting roller being selectively movable between a first position and a second position; and an adjusting unit to selectively move the track adjusting roller to the first position and the second position, wherein the track adjusting roller pulls the transfer belt outwardly in the first position, and the track adjusting roller supports the inwardly pressed transfer belt in the second position.

Also, according to aspects of the invention, the adjusting unit includes: a first rotating bracket to support the rotation of the track adjusting roller, with the first rotating bracket being rotatably installed to selectively move the track adjusting roller to the first position and the second position; a first elastic member to elastically press the first rotating bracket to guide the track adjusting roller to the second position; and a driving control unit to forcibly rotate the first rotating bracket to the first position to guide the track adjusting roller to the first position.

Further, according to aspects of the invention, the driving control unit includes: a drive motor rotatable in both directions; and a rotating lever rotatable by the drive motor, with the rotating lever having one end in interfering relation with the first rotating bracket to interwork toward the first position. In addition, according to aspects of the invention, the driving unit can include: a second rotating bracket rotatably installed to support the rotation of the second primary transfer roller; a second elastic member to elastically press the second rotating bracket in a direction where the second primary transfer roller is disengaged from the transfer belt; and a cam member rotatably installed to work with the second rotating bracket. Also, the cam member is coaxially combined with the rotating lever to provide rotation.

Moreover, according to aspects of the invention, the rotating lever has one end being connected to the first rotating bracket, and the other end being connected to the second rotating bracket, with the rotating lever forcibly engaging one of the first and second rotating brackets according to the direction of rotation.

Further, according to aspects of the invention, the driving unit includes: a second rotating bracket rotatably installed to support the rotation of a second primary transfer roller; a second elastic member to elastically press the second rotating bracket in a direction where the second primary transfer roller is disengaged from the transfer belt; and a cam member rotatably installed to work with the second rotating bracket, with the cam member being engaged with the belt length adjusting unit.

Additionally, according to aspects of the invention, the first and second image bearing bodies are sequentially formed in the traveling direction of the transfer belt between the driven roller and the driving roller. The image forming apparatus, according to aspects of the invention, further includes: at least one stabilizing roller rotatably and movably installed adjacent to the second primary roller, with the stabilizing roller selectively engaging or disengaging the second primary transfer roller and the transfer belt with or from the second image bearing body.

The image forming apparatus, according to aspects of the invention further includes: a tension adjusting unit installed on the traveling track of the transfer belt in the direction of, or heading for, the driven roller via the driving roller, with the tension adjusting unit adjusting the tension of the transfer belt. Also, according to aspects of the invention, the tension adjusting unit includes: a tension roller to support the transfer belt; and a pressing member to elastically press the tension roller toward the transfer belt.

Moreover, according to aspects of the invention, the first image bearing body includes color image bearing bodies to sequentially transfer and superpose a plurality of color images onto the transfer belt, and the second image bearing body includes a mono image bearing body to transfer a single color image onto the transfer belt.

Also, according to aspects of the invention, the image forming apparatus further includes: a secondary transfer roller rotating in contact with the transfer belt in correspondence to the driving roller, with the secondary transfer roller transferring an image on the transfer belt to a printing medium. Moreover, according to aspects of the invention, the first primary transfer roller is installed to be selectively engaged and disengaged with and from the first image bearing body. Additionally, according to aspects of the invention, the adjusting roller has a smaller external diameter than the second primary transfer roller.

Another aspect and embodiment, among the several aspects and example embodiments of the invention, provides a control method of driving an image forming apparatus, the method including: moving a transfer belt supported by a driven roller and a driving roller to travel in one, or a predetermined, direction; forming a first predetermined color image on the transfer belt by using a first image bearing body in contact with the transfer belt; engaging the transfer belt with a second image bearing body by changing the traveling track of the transfer roller without causing a change in the length of the transfer belt between the first image bearing body and the driving roller; and transferring a second predetermined color image onto the transfer belt by using the second image bearing body.

Additionally, according to aspects of the invention, the operation of forming the first predetermined color image on the transfer belt includes the operations of: in a first rotation of the transfer belt, forming an image of a first color on the transfer belt; in a second rotation of the transfer belt, superposing a second color with the first color image to form a two-color superposed image; and in a third rotation of the transfer belt, superposing a third color with the two-color superposed image and thereby, forming a three-color superposed image.

Also, according to aspects of the invention, the operation of engaging the transfer belt with the second image bearing body is carried out after the completion of the operation of superposing the second color with the first color image, although the invention is not limited in this regard. Further, according to aspects of the invention, the operation of engaging the transfer belt with the second image bearing body is carried out before the three-color image goes via the second image bearing body, although the invention is not limited in this regard.

Additionally, according to aspects of the invention, the operation of engaging the transfer belt with the second image bearing body includes the operations of: changing the position of a primary transfer roller installed on the opposite side of the second image bearing body to pull the transfer belt outwardly to engage with the second image bearing body; and guiding the transfer belt, which travels between the second image bearing body and the driving roller, to retreat inwardly by a predetermined distance to compensate for a change in the traveling distance caused by the primary transfer roller.

Further, according to aspects of the invention, in the operation of guiding the transfer belt, a movable adjusting roller installed in contact with transfer belt to provide support is moved inwardly of the transfer belt. Also, according to aspects of the invention, the operations of changing the position of the primary transfer roller and guiding the transfer belt are performed at the same time, although the invention is not limited in this regard. Moreover, according to aspects of the invention, in the operation of changing the position of the primary transfer roller, a stabilizing roller installed adjacent to the primary transfer roller to guide the traveling of the transfer belt is moved together with the primary transfer roller. In addition, according to aspects of the invention, the first image includes a superposed color image obtained from superposition of yellow, magenta and cyan color images, and the second image includes a black image, although the invention is not limited in this regard.

Also, according to aspect of the invention, the printing medium, in addition to being a paper type media, can also be other types of media, such as film type media or media for overheads or transparencies, or other suitable type media for image forming, in practice and applications of the invention. As such, references herein to printing medium can correspond to various suitable medium or media, and the references to image forming apparatus can also apply to corresponding image forming apparatus for various suitable media, according to aspects of the invention.

Additional aspects and/or advantages of the invention are set forth in the description which follows or are evident from the description, or can be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
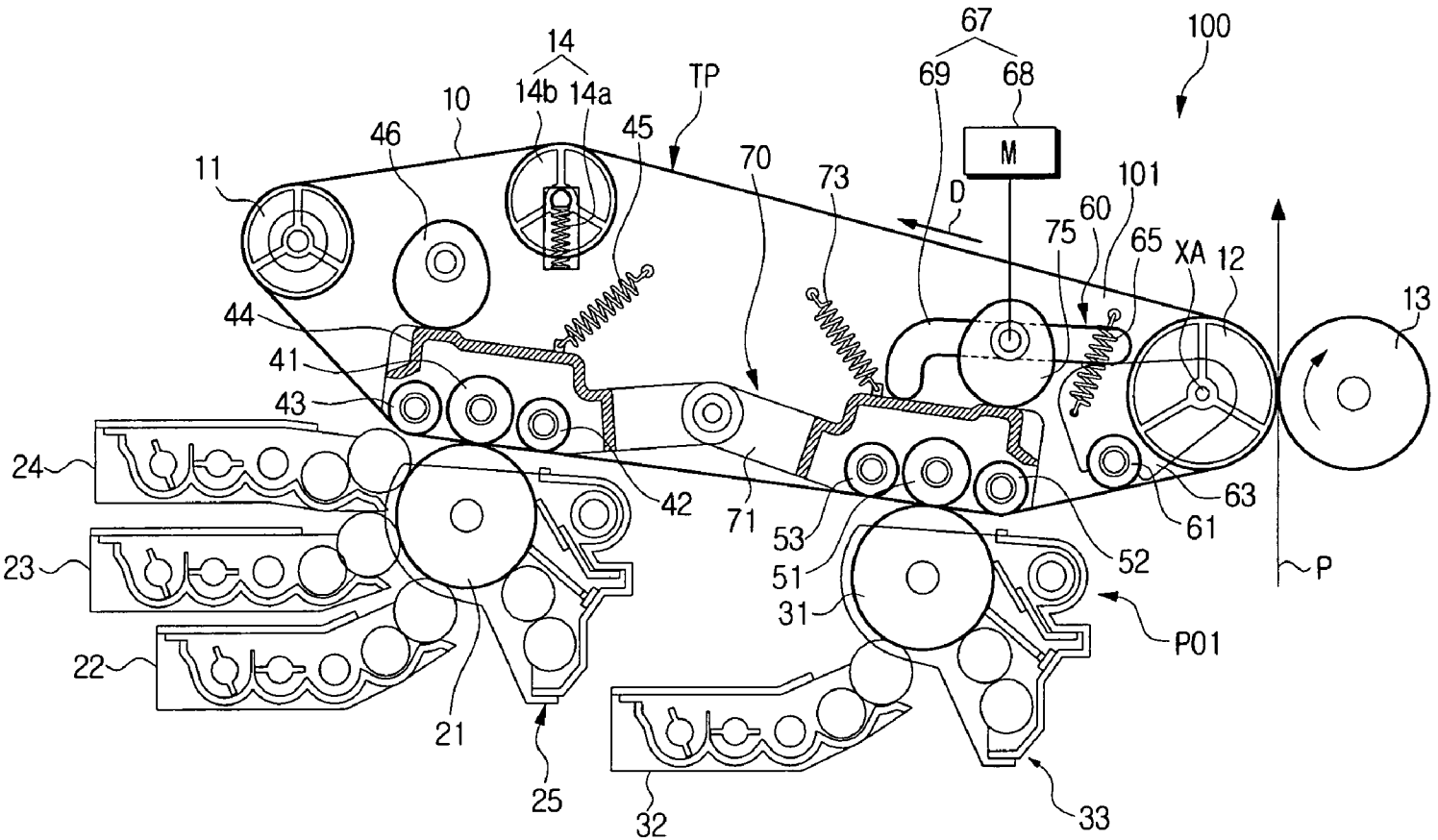
FIG. 1 is a schematic diagram of an image forming apparatus according to an embodiment of the invention.

Reference will now be made in detail to embodiments of the invention, examples of which are illustrated in the accompanying drawings, wherein like reference numerals refer to the like elements throughout. The embodiments are described below in order to explain aspects of the invention by referring to the figures, with well-known functions or constructions not necessarily being described in detail.

Referring to FIG. 1, an image forming apparatus 100 according to an embodiment of the invention includes a transfer belt 10 being supported by a driving roller 12 and a driven roller 11 to travel an endless track, a first image bearing body 21 and a second image bearing body 31 to form and transfer an image of a designated color onto the transfer belt 10, a first primary transfer roller 41 installed corresponding to the first image bearing body 21, a second primary transfer roller 51 installed corresponding to the second image bearing body 31, a belt length adjusting unit 60, and a driving unit 70 to move the second primary transfer roller 51 between first and second positions.

The transfer belt 10 is where images formed on the surface of each of the image bearing bodies 21 and 31 are transferred primarily, and those images are transferred by the transfer belt 10 onto a printing medium P that passes between a secondary transfer roller 13 and the transfer belt 10 itself. Such a transfer belt 10 is supported not only by the driven roller 11 and the driving roller 12, but also by the first and second primary transfer rollers 41 and 51 in driving the transfer belt 10.

In addition, the image forming apparatus 100 further includes a tension adjusting unit 14 to control the tension of the transfer belt 10, so as to maintain the tension at a constant level. The tension adjusting unit 14 includes a tension roller 14*b* installed on the belt travel path, or traveling track, TP between the driving roller 12 and the driven roller 11 in order to support traveling of the transfer belt 10, and a pressing member 14*a* to elastically press against the tension roller 14*b* in the direction where the tension of the transfer belt 10 increases. The pressing member 14*a* can include a spring.

The first image bearing body 21 and the second image bearing body 31 are aligned at regular intervals on the path of the transfer belt 10 traveling from the driven roller 11 to the driving roller 12. In the embodiment of FIG. 1, for example, the first image bearing body 21 corresponds to a color image bearing body to form a first image by transferring and superposing a plurality of color images onto the transfer belt 10, and the second image bearing body 31 corresponds to a mono image bearing body to develop a monochromatic image (a second image) of black. In this regard, for example, the first image bearing body 21 sequentially transfers and superposes each of yellow, magenta and cyan color images onto the transfer belt 10. Developing units 22, 23, and 24 to develop the yellow, magenta and cyan color images, respectively, are installed around the first image bearing body 21, and the developing units 22, 23 and 24 provide, in conjunction with the first image bearing body 21, a plurality of color image bearing bodies. Reference numeral 25 denotes a cleaning unit 25 to clean the first image bearing body 21.

The second image bearing body 31 is typically placed downstream of the first image bearing body 21 with respect of the traveling direction D of the transfer belt 10. The second image bearing body 31 transfers and superposes black onto a superposed image that results from the superposition of yellow, magenta and cyan color images. A developing unit 32 to developing black color and a cleaning unit 33 are installed around the second image bearing body 31. A charging unit and an exposure unit to charge and expose the surfaces of the first and second image bearing bodies 21 and 31 are also included in the image forming apparatus 100 of FIG. 1, as known to those skilled in the art.

The first primary transfer roller 41 is installed on the opposite side of the first image bearing body 21 having the transfer belt 10 positioned in-between. As the first primary transfer roller 41 positions the transfer belt 10 closely toward the side of the first image bearing body 21, a color image formed on the first image bearing body 21 is transferred onto the transfer belt 10. Stabilizing rollers 42 and 43 are disposed in the front and in the rear of the first primary transfer roller 41, respectively, to rotate so as to support the transfer belt 10, wherein a predetermined area of the transfer belt 10 comes in contact with the first image bearing body 21 during rotation. The first primary transfer roller 41 and the stabilizing rollers 42 and 43 are rotatably supported by a rotating bracket 44. The rotating bracket 44 is installed and pressed by a spring 45 in the opposite direction of the first image bearing body 21. Also, a cam member 46 is installed to forcibly push the rotating bracket 44 toward the transfer belt 10 to provide support, wherein the first image bearing body 21 becomes selectively engaged with and disengaged from the transfer belt 10. For exchange and after-sales service of the image bearing body 21, the first image bearing body 21 can easily be disengaged from the transfer belt 10.

The second primary transfer roller 51 is installed on the opposite side of the second image bearing body 31 having the transfer belt 10 positioned in-between. The second primary transfer roller 51 selectively engages and disengages the transfer belt 10 with and from the second image bearing body 31, and the second primary transfer roller 51 is installed to selectively move between a first position and a second position by the driving control unit 67. As illustrated in FIG. 1, the first position PO1 corresponds to a state in which an image formed on the second image bearing body 31 is transferred onto the transfer belt 10 by pulling the transfer belt 10 outwardly to contact or engage with the second image bearing body 31. Further, as illustrated in FIG. 2, the second position PO2 corresponds to a state in which the second primary transfer roller 51 moves inwardly of the transfer belt 10 by making the transfer belt 10 disengage from the second image bearing body 31.

When a developed color image is superposed on the transfer belt 10 by the first image bearing body 21, the second primary transfer roller 51 moves toward the second position PO2, to disengage the transfer belt 10 and the second image bearing body 31 from each other. Moreover, to develop black color using the second image bearing body 31, the second primary transfer roller 51 causes the transfer belt 10 and the second image bearing body 31 to contact or engage with each other, so that the black image can be transferred onto the transfer belt 10.

When the second primary transfer roller 51 shifts between the first position PO1 and the second position PO2, the belt length adjusting unit 60 not only keeps the tension of the transfer belt 10 at a constant level, but also ensures that the length of the transfer belt 10 is not changed between the driven roller 11 and the driving roller 12. In this regard, the belt length adjusting unit 60 changes the track of the transfer belt 10 traveling from the driven roller 11 to the driving roller 12. The belt length adjusting unit 60 includes an adjusting roller 61 movably installed, a first rotating bracket 63 to support the adjusting roller 61, a first elastic member 65 to press the first rotating bracket to allow the adjusting roller 61 to move inwardly of the transfer belt 10, and a driving control unit 67 to forcibly rotate the first rotating bracket 63.

Figure 2:
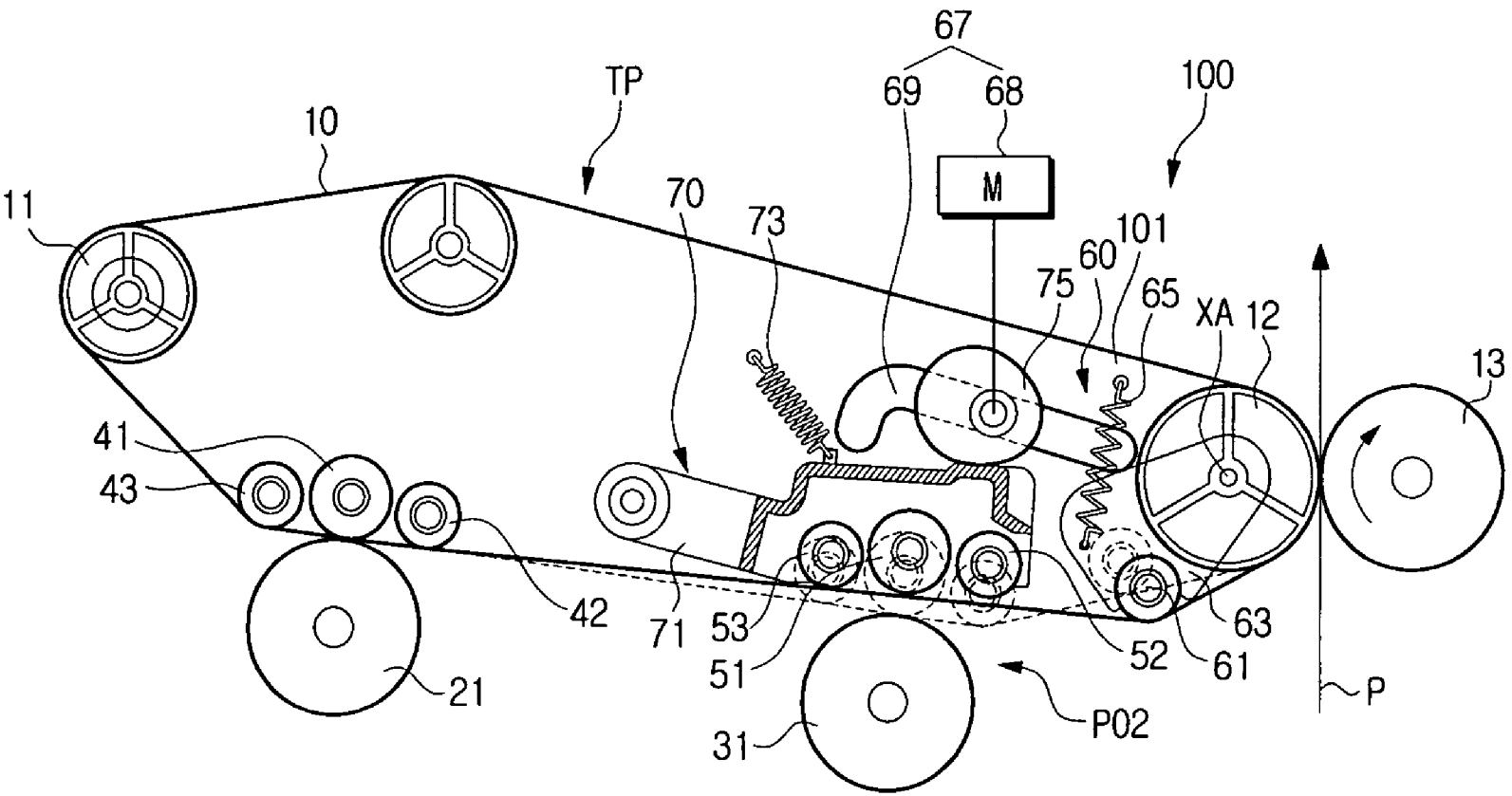
FIG. 2 is a diagram for explaining a state in which a transfer belt with the position shown in FIG. 1 is disengaged from a second image bearing body, according to aspects of the invention.

As depicted in FIGS. 1 and 2, the adjusting roller 61 is typically placed downstream of the second primary transfer roller 51 with respect to the traveling path TP of the transfer belt 10, and guides the traveling of the transfer belt 10. The adjusting roller 61 is driven in the opposite direction of the second primary transfer roller 51. In this regard, for example, if the second primary transfer roller 51 moves to the first position PO1, the adjusting roller 61 moves inwardly of the transfer belt 10, and thus compensates for an increase in tension and change in track of the transfer belt 10 according to a forward movement of the second primary transfer roller 51 in the outward direction of the transfer belt 10. On the contrary, if the tension of the transfer belt 10 is reduced as the second primary transfer roller 51 moves inwardly of the transfer belt 10, the adjusting roller 61, as shown in FIG. 2, moves to pull the transfer belt 10 outwardly to support the transfer belt 10 to travel at a constant level of tension.

The first rotating bracket 63 is rotatably installed coaxially with respect to the axis XA of the driving roller 12 and supports the adjusting roller 61. The first elastic member 65 is a spring, for example. One end of the first elastic member 65 is connected to the first rotating bracket 63, and the other end is connected to an internal unit or main body 101 of the image forming apparatus 100 to elastically press the first rotating bracket 63.

The driving control unit 67 includes a drive motor 68 rotatable in both directions, and a rotating lever 69 rotatable by the drive motor 68. One end of the rotating lever 69 is connected to, or engages with, the first rotating bracket 63 to work with the first rotating bracket 63. The other end of the rotating lever 69 is connected to, or engages with, a second rotating bracket 71 to work with the second rotating bracket 71. For example, when the rotating lever 69 rotates in the clockwise direction by a predetermined angle, the first rotating bracket 63 is pivoted counterclockwise, and, in response, the adjusting roller 61 pushes to support the transfer belt 10 outwardly, and the other end of the first rotating lever 69 allows the second rotating bracket 71 to rotate, to allow the second primary transfer roller 51 to move away from the second image bearing body 31.

The driving unit 70 includes the second rotating bracket 71 to support the second primary transfer roller 51, a second elastic member 73 and a cam member 75. The second rotating bracket 71 has one end being rotatably connected to the main body 101 of the image forming apparatus 100, and the second rotating bracket 71 supports the second primary transfer roller 51 to rotate about the other end of the second rotating bracket 71. The second rotating bracket 71 can be installed coaxially with the rotating bracket 44, for example. Also, a pair of stabilizing rollers 52 and 53 are installed at the other end of the second rotating bracket 71 in the front and in the rear of the second primary transfer roller 51. These stabilizing rollers 52 and 53, together with the second primary transfer roller 51, selectively engage or disengage the transfer belt 10 with or from the second image bearing body 31. Further, when the transfer belt 10 is engaged with the second image bearing body 31, the stabilizing rollers 52 and 53 provide a guide to permit a portion of the transfer belt 10 to contact with the second image bearing body 31.

One end of the second elastic member 73 is connected into the main body 101 of the image forming apparatus 100, and the other end of the second elastic member 73 is connected to the second rotating bracket 71 to press the second rotating bracket 71 toward the opposite direction of the second image bearing body 31. The second elastic member 73 is a spring, for example.

The cam member 75 forcibly pushes the second rotating bracket 71 toward the second image bearing body 31 or away from the second image bearing body 31 to release the same, according to the rotation status of the cam member 75. The cam member 75 is typically installed coaxially with the rotating lever 69 as one piece, for example. In this regard, the cam member 75 is installed coaxially with the rotating lever 69, and typically rotates at the same time by the drive motor 68. In this manner, the cam member 75 can control and work with the adjusting roller 61 and the second primary transfer roller 51. Thus, when the second primary transfer roller 51 changes its position, the adjusting roller 61 is also shifted. This allows the transfer belt 10 to amend, or change, its track without any change, or substantial change, in tension or length, and to selectively engage and disengage with and from the second image bearing body 31.

A control method to drive the image forming apparatus 100 according to an embodiment and aspects of the invention is described as follows. As shown in FIG. 2, the transfer belt 10 is disengaged from the second image bearing body 31, and only the first image bearing body 21 comes in contact with the transfer belt 10 during its traveling. Next, yellow, magenta, and cyan color images are sequentially formed by using the first image bearing body 21, and the images are transferred and superposed onto the transfer belt 10. In this regard, provided that the image forming apparatus 100 can transfer images on one sheet of paper, or other suitable printing medium P, for a rotation of the transfer belt 10, the image forming apparatus 100, for example, forms, during a first rotation of the transfer belt 10, a yellow (first color) image on the first image bearing body 21 using the developing unit 22 during the first rotation of the transfer belt 10. The yellow (first color) image formed on the first image bearing body 21 is transferred onto the transfer belt 10.

Then, when the transfer belt 10 makes the second rotation, the image forming apparatus 100 forms a magenta (second color) image on the first image bearing body 21 using the developing unit 23. The magenta (second color) image formed on the first image bearing body 21 is transferred onto the transfer belt 10 and superposed with the yellow (first color) image to make a two-color superposed image.

Continuing, when the transfer belt 10 makes the third rotation, the image forming apparatus 100 moves the second primary transfer roller 51 to the second position PO2 when a cyan (third color) image is being superposed using the developing unit 24 on the two-color superposed image on the transfer belt 10 or right before or right after the superposition, to cause the transfer belt 10 contact or engage with the second image bearing body 31. As described, when the stabilizing roller 61 moves inwardly of the transfer belt 10 at the same time as the second primary transfer roller 51 moves, the change in track of the transfer belt 10 is guided and the tension of the transfer belt 10 is maintained at a constant, or substantially constant, level. In this regard, when the track is changed and the tension is maintained at a constant level, the length of the transfer belt 10, more specifically, the traveling distance of the transfer belt 10 between the first image bearing body 21 and the driving roller 12 is not substantially changed but maintained uniformly.

Therefore, if the length of the transfer belt 10 is maintained uniformly, despite the change in the track, the transfer belt 10 traveling via the first image bearing body 21 is less likely to slip. In other words, when the image forming apparatus forms the cyan (third color) image and transfers and superposes the image onto the transfer belt 10 during its third rotation, the superposed image is not likely to slip or blur, providing a high-quality image.

Further, when the transfer belt 10 makes the third rotation, the image forming apparatus 100 transfers and superposes the cyan (third color) image from the first image bearing body 21 onto the transfer belt 10, and transfers and superposes a black image from the second image bearing body 31 thereon onto the three-color superposed image, resulting in a full-color superposed image. The formed full-color image is then transferred to the printing medium P that passes between the transfer belt 10 and the secondary transfer roller 13.

As explained, since the image forming apparatus 100, according to aspects of the invention, makes a full-color image by rotating the transfer belt 10 three turns, its printing speed can become faster than in the multi-pass system image forming apparatus using at least three image bearing bodies. In addition, since the image forming apparatus, such as the image forming apparatus 100, of the invention typically uses only two image bearing bodies to make a full-color image, the image forming apparatus, according to aspects of the invention, can be relatively small-sized and light-weight.

Also, the belt length adjusting unit of the image forming apparatus, according to aspects of the invention, such as the belt length adjusting unit 60 of the image forming apparatus 100, can stabilize the traveling track of the transfer belt, such as the transfer belt 10, when the transfer belt is selectively engaged and disengaged with and from the corresponding image bearing body, such as the first image bearing body 21 or second image bearing body 31. As a result, it can become possible to prevent changes in the length and tension of the transfer belt. Furthermore, a slipping problem of the transfer belt caused by the change in length of the transfer belt can be prevented, and an error like image inclination or banding due to, or resulting from, the slipping problem of the transfer belt can be suppressed.

Moreover, according to aspects of the invention, when the position of the primary transfer roller, such as the first a first primary transfer roller 41 or the second primary transfer roller 51 is changed to change the traveling track of the transfer belt, such as the transfer belt 10, position changing of the adjusting roller, such as the adjusting roller 61, in the belt length adjusting unit, such as the belt length adjusting unit 60, is typically carried out at the same time. In this manner, the tension of the transfer belt can be maintained at a constant, or substantially constant, level, and it becomes possible to fix a constant, or substantially constant, belt length, such as between the first image bearing body 21 and the driving roller 12.

Accordingly, since the image forming apparatus, according to aspects of the invention, can use a relatively lesser or smaller number of image bearing bodies to form a full-color image, the printing speed of the image forming apparatus can be faster or increased, deterioration in image quality can be prevented or significantly reduced, and product reliability can be improved.

The foregoing embodiments, aspects and advantages are merely exemplary and are not to be construed as limiting the invention. Also, the description of the embodiments of the invention is intended to be illustrative, and not to limit the scope of the claims, and various other alternatives, modifications, and variations will be apparent to those skilled in the art. Therefore, although a few embodiments of the invention have been shown and described, it would be appreciated by those skilled in the art that changes may be made in the embodiments without departing from the principles and spirit of the invention, the scope of which is defined in the claims and their equivalents.

What is claimed is:

1. An image forming apparatus, comprising:

a first image bearing body and a second image bearing body positioned to form predetermined images;

a transfer belt traveling in a predetermined direction to transfer images onto a printing medium, wherein the images are selectively formed on the first image bearing body and the second image bearing body and transferred and superposed onto the transfer belt;

a belt length adjusting unit to control a traveling distance of the transfer belt by changing a traveling track of the transfer belt to compensate for a change in the traveling track of the transfer belt; and a tension adjusting unit, positioned on the traveling track of the transfer belt to adjust a tension of the transfer belt.

2. The apparatus of claim 1, wherein:

the belt length adjusting unit controls the traveling distance of the transfer belt going via the first image bearing body and the second image bearing body to be constant by changing the traveling track of the transfer belt around the second image bearing body so as to compensate for a change in the traveling track of the transfer belt.

3. The apparatus of claim 1, wherein:

the belt length adjusting unit controls the traveling distance of the transfer belt going via the first image bearing body and the second image bearing body to be substantially constant by changing the traveling track of the transfer belt around the second image bearing body so as to compensate for a change in the traveling track of the transfer belt.

4. An image forming apparatus, comprising:

a first image bearing body and a second image bearing body aligned to form predetermined color images;

a transfer belt supported by a driving roller and a driven roller, the transfer belt traveling in a predetermined direction to transfer images onto a printing medium, wherein the images are selectively formed on the first image bearing body and the second image bearing body and transferred and superposed onto the transfer belt;

a first primary transfer roller installed on the opposite side of the first image bearing body, having the transfer belt positioned in-between;

a second primary transfer roller movably installed on the opposite side of the second image bearing body, having the transfer belt positioned in-between, to selectively engage and disengage the transfer belt with and from the second image bearing body by selectively changing a traveling track of the transfer belt;

a driving unit to drive the second primary transfer roller to selectively engage and disengage with and from the transfer belt;

a belt length adjusting unit to control a traveling distance of the transfer belt by changing the traveling track of the transfer belt to compensate for a change in the traveling track of the transfer belt; and a tension adjusting unit, positioned on the traveling track of the transfer belt at a location between the driven roller and the driving roller, to adjust a tension of the transfer belt.

5. The apparatus of claim 4, wherein:

the belt length adjusting unit comprises:

a track adjusting roller disposed between the second primary transfer roller and the driving roller to support the transfer belt, the track adjusting roller being selectively movable between a first position and a second position; and an adjusting unit to selectively move the track adjusting roller to the first position and the second position, wherein the track adjusting roller pulls the transfer belt outwardly in the first position, and the track adjusting roller supports the transfer belt being inwardly pressed in the second position.

6. The apparatus of claim 5, wherein:

the adjusting unit of the belt length adjusting unit comprises:

a first rotating bracket to support the adjusting roller, the first rotating bracket to selectively move the adjusting roller to the first position and the second position;

a first elastic member to elastically press the first rotating bracket to guide the adjusting roller to the second position; and a driving control unit to forcibly rotate the first rotating bracket to the first position to guide the adjusting roller to the first position.

7. The apparatus of claim 6, wherein:

the driving control unit comprises:

a drive motor to rotate in both directions; and a rotating lever to rotate by the drive motor and having one end to engage with the first rotating bracket to work with the first rotating bracket to selectively move toward the first position.

8. The apparatus of claim 7, wherein:

the driving unit comprises:

a second rotating bracket to support the rotation of the second primary transfer roller;

a second elastic member to elastically press the second rotating bracket in a direction where the second primary transfer roller is disengaged from the transfer belt; and a cam member to work with the second rotating bracket.

9. The apparatus of claim 8, wherein:

the cam member is coaxially combined with the rotating lever to rotate the rotating lever.

10. The apparatus of claim 8, wherein:

the rotating lever has one end to engage with the first rotating bracket, and the rotating lever has the other end to engage with the second rotating bracket, to forcibly selectively engage the rotating lever with the first rotating bracket and the second rotating bracket according to the direction of rotation.

11. The apparatus of claim 8, wherein:

the first image bearing body comprises a plurality of color image bearing bodies each to sequentially transfer and superpose a corresponding color image onto the transfer belt, and the second image bearing body comprises a mono image bearing body to transfer a single color image onto the transfer belt.

12. The apparatus of claim 8, further comprising:

a secondary transfer roller to rotate in contact with the transfer belt in correspondence to the driving roller and to transfer an image on the transfer belt to a printing medium.

13. The apparatus of claim 8, wherein:

the belt length adjusting unit controls the traveling distance of the transfer belt going via the first image bearing body, the second image bearing body and the driving roller to be constant by changing the traveling track of the transfer belt around the second image bearing body so as to compensate for a change in the traveling track of the transfer belt caused by the second primary transfer roller.

14. The apparatus of claim 8, wherein:

the belt length adjusting unit controls the traveling distance of the transfer belt going via the first image bearing body, the second image bearing body and the driving roller to be substantially constant by changing the traveling track of the transfer belt around the second image bearing body so as to compensate for a change in the traveling track of the transfer belt caused by the second primary transfer roller.

15. The apparatus of claim 5, wheren:

the track adjusting roller has a smaller external diameter than the second primary transfer roller.

16. The apparatus of claim 4, wherein:

the driving unit comprises:

a rotating bracket to support the rotation of the second primary transfer roller;

an elastic member to elastically press the rotating bracket in a direction where the second primary transfer roller is disengaged from the transfer belt; and a cam member to work with the rotating bracket, with the cam member being engaged with the belt length adjusting unit.

17. The apparatus of claim 4, wherein:

the first image bearing body and the second image bearing body are sequentially positioned in a traveling direction of the transfer belt between the driven roller and the driving roller.

18. The apparatus of claim 4, wherein:

the tension adjusting unit comprises:

a tension roller to support the transfer belt; and a pressing member to elastically press the tension roller toward the transfer belt.

19. The apparatus of claim 4, wherein:

the first image bearing body comprises a plurality of color image bearing bodies each to sequentially transfer and superpose a corresponding color image onto the transfer belt, and the second image bearing body comprises a mono image bearing body to transfer a single color image onto the transfer belt.

20. The apparatus of claim 4, further comprising:

a secondary transfer roller to rotate in contact with the transfer belt in correspondence to the driving roller and to transfer an image on the transfer belt to a printing medium.

21. The apparatus of claim 4, wherein:

the first primary transfer roller selectively engages and disengages with and from the first image bearing body.

22. The apparatus of claim 4, wherein:

the belt length adjusting unit controls the traveling distance of the transfer belt going via the first image bearing body, the second image bearing body and the driving roller to be constant by changing the traveling track of the transfer belt around the second image bearing body so as to compensate for a change in the traveling track of the transfer belt caused by the second primary transfer roller.

23. The apparatus of claim 4, wherein:

the belt length adjusting unit controls the traveling distance of the transfer belt going via the first image bearing body, the second image bearing body and the driving roller to be substantially constant by changing the traveling track of the transfer belt around the second image bearing body so as to compensate for a change in the traveling track of the transfer belt caused by the second primary transfer roller.

24. An image forming apparatus, comprising:

a first image bearing body and a second image bearing body aligned to form predetermined color images;

a transfer belt supported by a driving roller and a driven roller, the transfer belt traveling in a predetermined direction to transfer images onto a printing medium, wherein the images are selectively formed on the first image bearing body and the second image bearing body and transferred and superposed onto the transfer belt;

a first primary transfer roller installed on the opposite side of the first image bearing body, having the transfer belt positioned in-between;

a second primary transfer roller movably installed on the opposite side of the second image bearing body, having the transfer belt positioned in-between, to selectively engage and disengage the transfer belt with and from the second image bearing body by selectively changing a traveling track of the transfer belt;

a driving unit to drive the second primary transfer roller to selectively engage and disengage with and from the transfer belt;

a belt length adjusting unit to control a traveling distance of the transfer belt by changing the traveling track of the transfer belt to compensate for a change in the traveling track of the transfer belt; and at least one stabilizing roller, positioned adjacent to the second primary transfer roller, to selectively engage and disengage the second primary transfer roller and the transfer belt with and from the second image bearing body.

25. A control method of driving an image forming apparatus, the method comprising:

moving a transfer belt supported by a driven roller and a driving roller to travel in a predetermined direction;

forming a first predetermined color image on the transfer belt by using a first image bearing body in contact with the transfer belt;

engaging the transfer belt with a second image bearing body by changing a traveling track of the transfer roller without causing a change in the length of the transfer belt between the first image bearing body and the driving roller; and transferring a second predetermined color image onto the transfer belt by using the second image bearing body, wherein the forming of the first predetermined color image on the transfer belt comprises:

in a first rotation of the transfer belt, forming an image of a first color on the transfer belt;

in a second rotation of the transfer belt, superposing a second color with the first color image to form a two-color superposed image; and in a third rotation of the transfer belt, superposing a third color with the two-color superposed image to form a three-color superposed image.

26. The method of claim 25, wherein:

the engaging the transfer belt with the second image bearing body is carried out after the completion of the superposing the second color with the first color image to form the two-color superposed image.

27. The method of claim 25, wherein:

the engaging the transfer belt with the second image bearing body is carried out before the three-color image goes via the second image bearing body.

28. The method of claim 26, wherein the engaging the transfer belt with the second image bearing body comprises:

changing a position of a primary transfer roller installed on the opposite side of the second image bearing body to pull the transfer belt outwardly to engage with the second image bearing body; and guiding the transfer belt, which travels between the second image bearing body and the driving roller, to retreat inwardly by a predetermined distance to compensate for a change in a traveling distance of the transfer belt caused by the primary transfer roller.

29. The method of claim 28, wherein:

in the guiding the transfer belt, moving inwardly of the transfer belt a movable adjusting roller installed to contact with transfer belt to support the transfer belt.

30. The method of claim 28, wherein:

the changing the position of the primary transfer roller and the guiding the transfer belt are performed at the same time.

31. The method of claim 26, wherein:

the first image comprises a superposed color image obtained from superposition of yellow, magenta and cyan color images, and the second image comprises a black image.

32. The method of claim 25, wherein the engaging the transfer belt with the second image bearing body comprises:

changing a position of a primary transfer roller installed on the opposite side of the second image bearing body to pull the transfer belt outwardly to engage with the second image bearing body; and guiding the transfer belt, which travels between the second image bearing body and the driving roller, to retreat inwardly by a predetermined distance to compensate for a change in a traveling distance of the transfer belt caused by the primary transfer roller.

33. The method of claim 32, wherein:

in the guiding the transfer belt, moving inwardly of the transfer belt a movable adjusting roller installed to contact with transfer belt to support the transfer belt.

34. The method of claim 32, wherein:

the changing the position of the primary transfer roller and the guiding the transfer belt are performed at the same time.

35. The method of claim 32, wherein:

in the changing the position of the primary transfer roller, moving together with the primary transfer roller a stabilizing roller installed adjacent to the primary transfer roller to guide the traveling of the transfer belt.

36. The method of claim 32, wherein:

the first image comprises a superposed color image obtained from superposition of yellow, magenta and cyan color images, and the second image comprises a black image.

37. The method of claim 32, further comprising:

maintaining a tension of the transfer belt at a constant level, and fixing a constant belt length between the first image bearing body and the driving roller.

38. The method of claim 37, further comprising:

controlling the traveling distance of the transfer belt by changing a traveling track of the transfer belt to compensate for a change in the traveling track of the transfer belt.

39. The method of claim 32, further comprising:

maintaining a tension of the transfer belt at a substantially constant level, and fixing a substantially constant belt length between the first image bearing body and the driving roller.

40. The method of claim 39, further comprising:

controlling the traveling distance of the transfer belt by changing a traveling track of the transfer belt to compensate for a change in the traveling track of the transfer belt.

41. The method of claim 25, wherein:

the first image comprises a superposed color image obtained from superposition of yellow, magenta and cyan color images, and the second image comprises a black image.

42. The method of claim 25, further comprising:

maintaining a tension of the transfer belt at a constant level, and fixing a substantially constant belt length between the first image bearing body and the driving roller.

43. The method of claim 42, further comprising:

controlling a traveling distance of the transfer belt by changing the traveling track of the transfer belt to compensate for a change in the traveling track of the transfer belt.

44. The method of claim 25, further comprising:

maintaining a tension of the transfer belt at a substantially constant level, and fixing a substantially constant belt length between the first image bearing body and the driving roller.

45. The method of claim 44, further comprising:

controlling the traveling distance of the transfer belt by changing a traveling track of the transfer belt to compensate for a change in the traveling track of the transfer belt.

46. A control method of driving an image forming apparatus, the method comprising:

moving a transfer belt supported by a driven roller and a driving roller to travel in a predetermined direction;

forming a first predetermined color image on the transfer belt by using a first image bearing body in contact with the transfer belt;

engaging the transfer belt with a second image bearing body by changing a traveling track of the transfer roller without causing a change in the length of the transfer belt between the first image bearing body and the driving roller; and transferring a second predetermined color image onto the transfer belt by using the second image bearing body, wherein:

the engaging the transfer belt with the second image bearing body comprises:

changing a position of a primary transfer roller installed on the opposite side of the second image bearing body to pull the transfer belt outwardly to engage with the second image bearing body, and guiding the transfer belt, which travels between the second image bearing body and the driving roller, to retreat inwardly by a predetermined distance to compensate for a change in a traveling distance of the transfer belt caused by the primary transfer roller; and in the changing the position of the primary transfer roller, moving together with the primary transfer roller a stabilizing roller installed adjacent to the primary transfer roller to guide the traveling of the transfer belt.

* * * * *

UNITED STATES PATENT AND TRADEMARK OFFICE

CERTIFICATE OF CORRECTION

PATENT NO. : 7,620,353 B2
APPLICATION NO. : 11/491076
DATED : November 17, 2009
INVENTOR(S) : Jin-geun Kwak et al.

It is certified that error appears in the above-identified patent and that said Letters Patent is hereby corrected as shown below:

Column 12, Line 39, change "wheren:" to --wherein:--.

Column 14, Line 27, change "claim 26," to --claim 25,--.

Column 14, Line 46, change "claim 26," to --claim 25,--.

Signed and Sealed this

Sixth Day of July, 2010

David J. Kappos

David J. Kappos
*Director of the United States Patent and Trademark Office*